US007685939B2

(12) United States Patent
Narumi

(10) Patent No.: US 7,685,939 B2
(45) Date of Patent: Mar. 30, 2010

(54) IGNITION CHARGE FOR INITIATOR AND METHOD OF PRODUCTION

(75) Inventor: Kazuhito Narumi, Kasama (JP)

(73) Assignee: Showa Kinzoku Kogyo Co., Ltd, Ibaraki (JP)

( * ) Notice: Subject to any disclaimer, the term of this patent is extended or adjusted under 35 U.S.C. 154(b) by 36 days.

(21) Appl. No.: 11/616,090

(22) Filed: Dec. 26, 2006

(65) Prior Publication Data

US 2007/0144636 A1 Jun. 28, 2007

(30) Foreign Application Priority Data

Dec. 28, 2005 (JP) ..... 2005-377184

(51) Int. Cl.
*F23Q 7/02* (2006.01)
*F42C 19/12* (2006.01)

(52) U.S. Cl. ..... 102/202; 102/202.5

(58) Field of Classification Search ..... 102/202, 102/202.5, 202.7, 202.9, 202.11
See application file for complete search history.

(56) References Cited

U.S. PATENT DOCUMENTS

| | | | | |
|---|---|---|---|---|
| 3,189,762 | A | 6/1965 | Galpin | |
| 3,511,586 | A * | 5/1970 | Seeger et al. | 431/361 |
| 3,695,179 | A * | 10/1972 | Rainone et al. | 102/202.11 |
| 5,147,976 | A * | 9/1992 | Laurensou et al. | 102/275.3 |
| 5,403,036 | A * | 4/1995 | Zakula et al. | 280/741 |
| 5,648,634 | A * | 7/1997 | Avory et al. | 102/202.1 |
| 6,612,243 | B1 * | 9/2003 | Italiane et al. | 102/367 |
| 6,783,616 | B1 | 8/2004 | Krone et al. | |
| 2006/0162607 | A1 * | 7/2006 | Kodama et al. | 102/530 |

FOREIGN PATENT DOCUMENTS

| | | |
|---|---|---|
| EP | 0 780 659 | 6/1997 |
| EP | 1 541 958 | 6/2005 |
| EP | 1 548 391 | 6/2005 |
| JP | 9-210596 | 8/1997 |
| JP | 31-002624 | 12/1997 |
| JP | 2004-115001 | 4/2004 |
| WO | WO 2005/026081 | 3/2005 |

OTHER PUBLICATIONS

Office action in corresponding Japanese Patent Application No. JP2005-377184, mailed on Nov. 13, 2009.

* cited by examiner

*Primary Examiner*—Bret Hayes
(74) *Attorney, Agent, or Firm*—Oblon, Spivak, McClelland, Maier & Neustadt, L.L.P.

(57) ABSTRACT

An ignition charge for an initiator provided with an igniting mechanism for setting aflame an ignition charge by the heat generated by an exothermic element connected via a pair of current conducting pins in response to an electric signal is a slurry ignition charge which is formed mainly of a mixture consisting of zirconium as a fuel component and potassium perchlorate as an oxidizing agent component. The ignition charge for the initiator contains nitrocellulose as a binder component in an extrapolated compounding ratio of 0.1% by weight or more and 0.5% by weight or less based on the total amount of zirconium and potassium perchlorate and isoamyl acetate as a solvent in an extrapolated compounding ratio of 12.5% by weight or more and 14.0% by weight or less based on the total amount of zirconium and potassium perchlorate. The ignition charge is spread on the exothermic element and dried. The ignition charge is for the initiator of a gas generator, particularly an electric gas generator.

3 Claims, 5 Drawing Sheets

IGNITION CHARGE FOR INITIATOR AND METHOD OF PRODUCTION

BACKGROUND OF THE INVENTION

1. Field of the Invention

This invention relates to an ignition charge for the initiator of a gas generator, particularly an electric gas generator, suitable for the purpose of actuating a seatbelt pretensioner or an airbag inflator, a method for the production thereof, and a method for the production of an initiator using the ignition charge.

2. Description of the Prior Art

Generally, wheeled vehicles, such as automobiles, are provided with a safety device, such as a seatbelt or an airbag, with a view to protecting a driver and a fellow passenger from the impact inflicted in case of collision. The seatbelt, for example, has a quick winding means attached to a device for winding a belt and, in an emergency arising from an accident, is enabled to protect infallibly the driver and the fellow passenger from the impact of collision by actuating the quick winding means and consequently causing the seatbelt to be instantaneously wound up.

As the quick winding means of this kind, numerous devices that utilize a gas generator adapted to generate a gas by the combustion of an explosive have been in great vogue. They operate on the principle that a belt is quickly wound by causing an explosive in the gas generator to burn by means of an electric ignition device including a pair of current conducting pins adapted to be actuated by an impact taking place in case of collision and harnessing the pressure of the resultant gas of combustion for instantaneously driving the piston and the body of rotation of a cylinder.

While this electric initiator uses an ignition charge, it used to make use of an ignition charge that contained lead formed mainly of tricinate (lead styphnate) sensitive to temperature. Since a regulation for controlling the use of an ignition charge containing lead, a substance for environmental load, has recently been rigidified, the ignition charge using a mixture of a flammable substance containing no lead and comprising zirconium and an oxidizing agent containing no lead and comprising potassium perchlorate has been finding acceptance.

For this ignition charge, the method which comprises adding a binder and a solvent to a powdery flammable substance consisting of zirconium, etc. and a powdery oxidizing agent consisting of potassium perchlorate, pelletizing the resultant mixture by the use of a stone mill, subsequently unifying the resultant pellets into a granular ignition charge, measuring a prescribed volume of the ignition charge and squeezing the measured ignition charge on an exothermic element is available.

Besides, the method which, as disclosed in JP-A 2004-115001 and JP-A HEI 9-210596, for example, forms an ignition charge by dispersing a flammable substance and an oxidizing agent in a solvent, converting the resultant dispersion into a slurry, dropping this slurry onto an exothermic element and drying the wet ignition charge is available.

The ignition charge obtained on the exothermic element by these methods is manufactured, by disposing a case, a pin and a resin mold around it, into an initiator.

In the initiator configured as described above, when the impact arising in case of collision is inflicted as an electric signal to a pair of current conducting pins, the exothermic element disposed between the current conducting pins begins to generate heat and the heat sets the ignition charge aflame and then actuates the gas generator for a seatbelt pretensioner or the inflator for an airbag.

When the gas generator for the seatbelt pretensioner is actuated, the pressure of the resultant gas of combustion instantly actuates the quick winding means of the seatbelt. When the inflator for the airbag is actuated, the pressure of the resultant gas of combustion instantaneously inflates the airbag.

The conventional ignition charge for use in the initiator, as described above, has been obtained in the form of granules by a procedure that comprises adding a binder and a solvent to a powdery flammable substance consisting of zirconium and a powdery oxidizing agent consisting of potassium perchlorate, pelletizing the resultant mixture by the use of a stone mill, and subsequently imparting a uniform size to the pellets. Further, the prescribed volume of this ignition charge is measured and then squeezed onto an exothermic element. Since this method is required to limit the solvent to a small amount during the course of pelletization, however, it has a high possibility that the ignition charge will catch fire during the course of its production owing to the friction occurring as in the stone mill. Though the reliability of ignition is high because the exothermic element and the ignition charge are made to adhere by the squeezing, the possibility of deriving ignition from the same friction as in the case of the pelletization is high because the squeezing is implemented by the use of a granular drying agent. Thus, the security of safety in terms of production has constituted a serious problem.

The method that forms an ignition charge by dispersing a flammable substance and an oxidizing agent in a solvent, thereby forming slurry, subsequently dropping the slurry on an exothermic element and drying the wet exothermic element as described above has been proposed in JP-A 2004-115001 and JP-A HEI 9-210596. This method is capable of greatly easing the influence of the friction during the intimate mixing because the amount of the solvent is large and the mixture assumes the form of slurry. When the amount of the solvent in this slurry is unduly large, however, the part contacting the exothermic element part suffers occurrence of air gaps and holes while the solvent in the ignition charge formerly dropped onto the exothermic element part is dried, with the result that the reliability of ignition will be seriously degraded. In contrast, when the amount of the solvent in the slurry is unduly small, the shortage results in not only rendering security of uniform intimate mixing infeasible but also degrading markedly the reliability of contact with the exothermic element part. Thus, the problems have inevitably occurred in the ranges of compositions disclosed in JP-A 2004-115001 and JP-A HEI 9-210596.

This invention, therefore, has as its object to provide an ignition charge for an initiator aimed at reconciling the safety during the production of the ignition charge and the reliability of ignition, a method for the production thereof, and a method for the production of an initiator using the ignition charge.

DISCLOSURE OF THE INVENTION

To attain the above object, the present invention provides as the first aspect thereof an ignition charge for an initiator provided with an igniting mechanism for setting aflame an ignition charge by heat generated by an exothermic element connected via a pair of current conducting pins in response to an electric signal, the ignition charge being a slurry ignition charge which is formed mainly of a mixture consisting of zirconium as a fuel component and potassium perchlorate as an oxidizing agent component and which contains nitrocellulose as a binder component in an extrapolated compounding ratio of 0.1% by weight or more and 0.5% by weight or less based on the total amount of zirconium and potassium perchlorate and isoamyl acetate as a solvent in an extrapolated compounding ratio of 12.5% by weight or more and 14.0% by weight or less based on the total amount of zirconium and potassium perchlorate, the ignition charge being spread on the exothermic element and dried.

In an ignition charge for an initiator according to the second aspect of the invention that includes the first aspect of the invention, the zirconium and the potassium perchlorate contained in the ignition charge have a weight ratio of 50 to 70% of zirconium to 30 to 50% of potassium perchlorate.

The present invention also provides as the third aspect thereof a method for the production of the ignition charge according to the first or second aspect of the invention, comprising the step of handling the zirconium in a state converted into slurry with isoamyl acetate.

The present invention further provides as the fourth aspect thereof a method for the production of the initiator according to the first or second aspect of the invention, comprising the steps of throwing into a syringe the ignition charge according to the first or second aspect of the invention, spreading the ignition charge thrown in the syringe on the exothermic element with a dispenser and then drying the spread ignition charge at room temperature or an elevated temperature.

The ignition charge of this invention for an initiator is capable of providing, for an initiator provided with an igniting mechanism for setting aflame an ignition charge by the heat generated by an exothermic element connected via a pair of current conducting pins in response to an electric signal, an ignition charge that possesses high reliability and high safety.

Then, the method of this invention for the production of an ignition charge for an initiator is capable of implementing the production with high safety because the zirconium is handled in a state converted into slurry with isoamyl acetate and therefore is enabled to be desensitized against static electricity during the course of production.

Further, the method of this invention for the production of an initiator is capable of producing an initiator stable in quality and excellent in safety because the ignition charge thrown in a syringe is spread on an exothermic element with a dispenser and then dried at room temperature or an elevated temperature.

The above and other objects, characteristic features of the invention will become apparent to those skilled in the art from the description to be given herein below with reference to the accompanying drawings.

DETAILED DESCRIPTION OF THE PREFERRED EMBODIMENT

Figure 1:
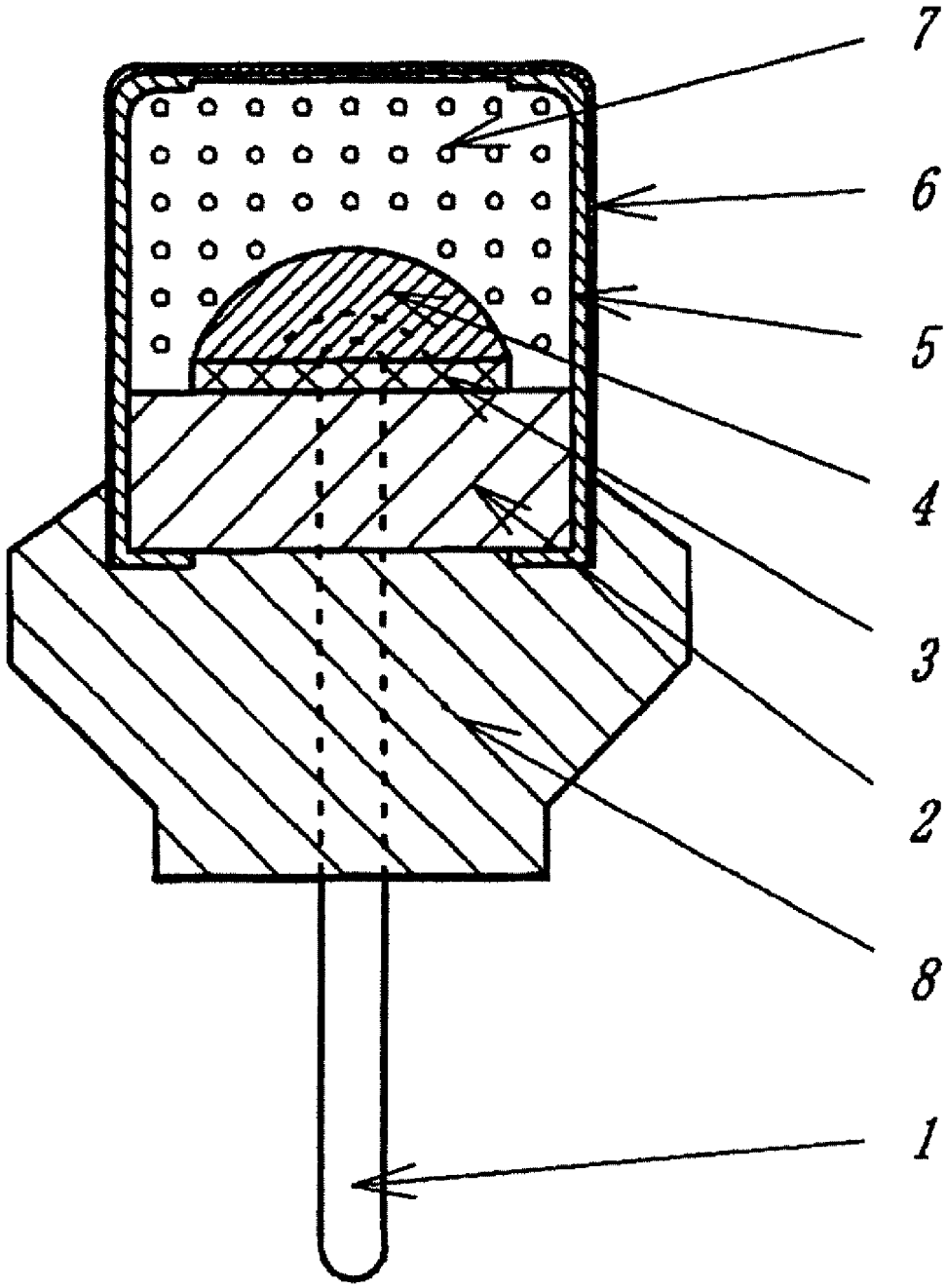
FIG. 1 is a cross section showing one embodiment of an electric ignition initiator contemplated by this invention.

The ignition charge (ignition charge) contemplated by this invention is a slurry ignition charge containing zirconium as a fuel component and potassium perchlorate as an oxidizing agent component and preferring to incorporate zirconium and potassium perchlorate therein at a ratio of 50 to 70% of zirconium and 30 to 50% of potassium perchlorate by weight. If the ratio of zirconium falls short of 50% and the ratio of potassium perchlorate exceeds 50% between the zirconium and the potassium perchlorate, a disadvantage ensues that the ability to inflame the gas generator will be degraded and consequently the operating time of the gas generator will be retarded. Conversely, if the ratio of zirconium exceeds 70% and the ratio of potassium perchlorate falls short of 30%, a disadvantage ensues that the ability of the ignition charge to catch fire will be deteriorated and consequently the operating time of the gas generator will be retarded.

The extrapolated compounding ratio of nitrocellulose to be contained as a binder component in the ignition charge of this invention is preferably 0.1% by weight or more and 0.5% by weight or less based on the total amount of zirconium and potassium perchlorate. If the extrapolated compounding ratio of nitrocellulose falls short of 0.1% by weight, the slurry will be incapable of securing due fluidity. Conversely, if this extrapolated compounding ratio exceeds 0.5% by weight, the excess will be at a disadvantage in compelling the slurry, while being dried, to incur occurrence of air voids and consequently entail degradation of the reliability of ignition, i.e. the most important quality being sought, and, in the case of being spread with a dispenser, reveal deficiency in the ability of mass-production due to unduly high viscosity.

The amount of isoamyl acetate to be contained as a solvent in the ignition charge of this invention is 12.5% by weight or more and 14.0% by weight or less based on the total amount of zirconium and potassium perchlorate. If this ratio falls short of 12.5% by weight, the slurry will be incapable of acquiring due fluidity. Conversely, if the ratio exceeds 14.0% by weight, the excess will be at a disadvantage in degrading the reliability of ignition, i.e. the most important quality being sought, owing to the occurrence of air voids and inducing separation of the components, zirconium and potassium perchlorate, by sedimentation in the slurry as well.

The nitrocellulose serving as the binder is preferably dissolved in advance in the amyl perchlorate serving as the solvent.

Then, in the method for the production of the ignition charge of this invention, zirconium is handled in a state converted into slurry with isoamyl acetete. The reason for this particular state is that zirconium powder in a dry state is remarkably sensitive to static electricity and has a possibility of inducing an accident of ignition during the course of production of the ignition charge. This state, therefore, is beneficial to the retention of safety during the course of production.

Further, the method for the production of the initiator of this invention, in the operation of spreading the ignition charge, permits adoption of the process of spreading that uses a dispenser generally used in the field of semiconductors.

This process is beneficial as well to the retention of safety because it permits the drying of isoamyl acetate as the solvent to be carried out at normal temperature. When the drying is implemented by heating, it suffices to perform the drying in due consideration of the quality and the safety of the ignition charge.

Now, this invention will be explained in detail below by reference to the drawings illustrating one embodiment.

FIG. 1 is a cross section conceptually showing the embodiment of an electric ignition initiator according to this invention. The initiator illustrated herein is intended for application to the safety device for a wheeled vehicle, such as a seatbelt or an airbag, explained formerly and is provided with two pins 1 adapted to serve as an interface with the wheeled vehicle. The pair of pins 1 form part of a stem 2. A substrate 3 provided with a heat-generating part (not shown) is disposed on the pin 1 on the inner side of the stem 2 and the opposite end parts of the heat-generating part are joined to the pins 1 with solder. An ignition charge 4 in a slurry state is spread on the heat-generating part of the substrate 3 and subsequently dried. Meantime, an ignition powder 7 in a prescribed amount is thrown in a metallic case 5 inserted in a resinous case 6.

The stem 2 on which the ignition charge 4 has been spread and dried is inserted into the metallic case 5 containing the ignition powder 7, immobilized by caulking and then equipped with a resinous mold 8 possessing a shape proper to be fixed to the gas generator for a seatbelt or the inflator for an airbag. The process described above leads to configuration of the initiator.

Figure 2:
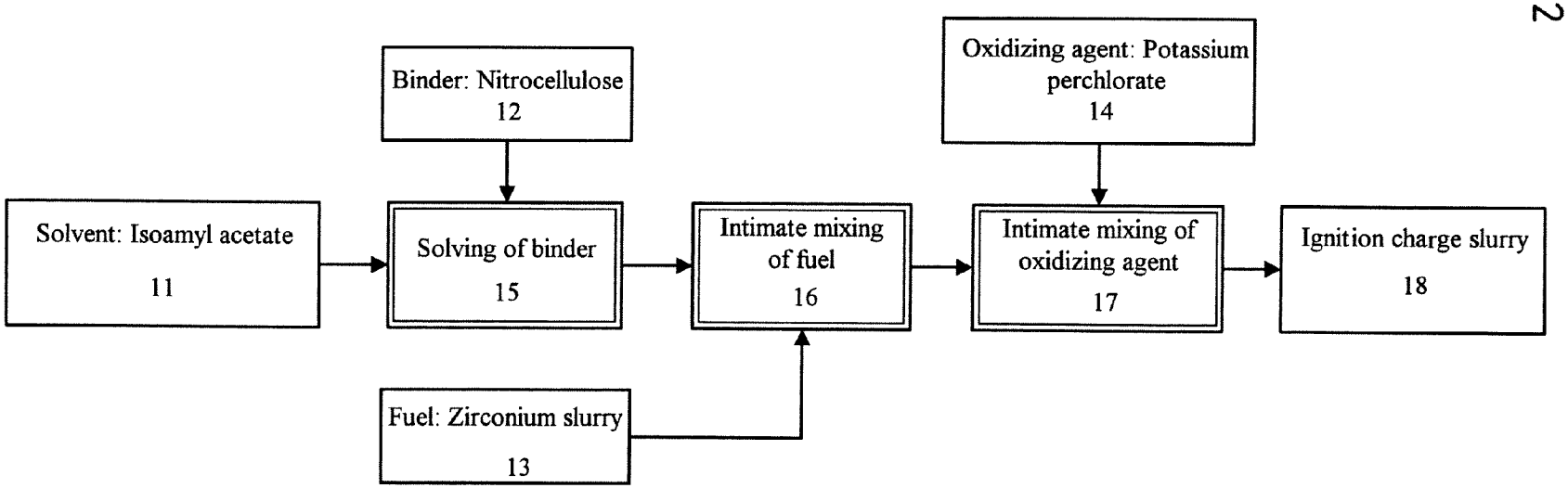
FIG. 2 is a block diagram showing a method for the production of an ignition charge contemplated by this invention.

FIG. 2 is a block diagram showing a method for the production of an ignition charge. First, nitrocellulose 12 as a binder weighed out in a prescribed amount is added to isoamyl acetate 11 as a solvent weighed out in a prescribed amount and they are subjected to a treatment for binder solution 15. Then, zirconium slurry 13 using isoamyl acetate adjusted to a prescribed amount relative to a prescribed amount of zirconium is added to a binder solution resulting from the binder solution 15 and subjected to a treatment for intimate mixing of fuel 16. Subsequently, potassium perchlorate 14 weighed out in a prescribed amount is added to the slurry resulting from the intimate mixing of fuel 16 and subjected to a treatment for intimate mixing of oxidizing agent 17 to complete an ignition charge slurry 18.

Figure 3:
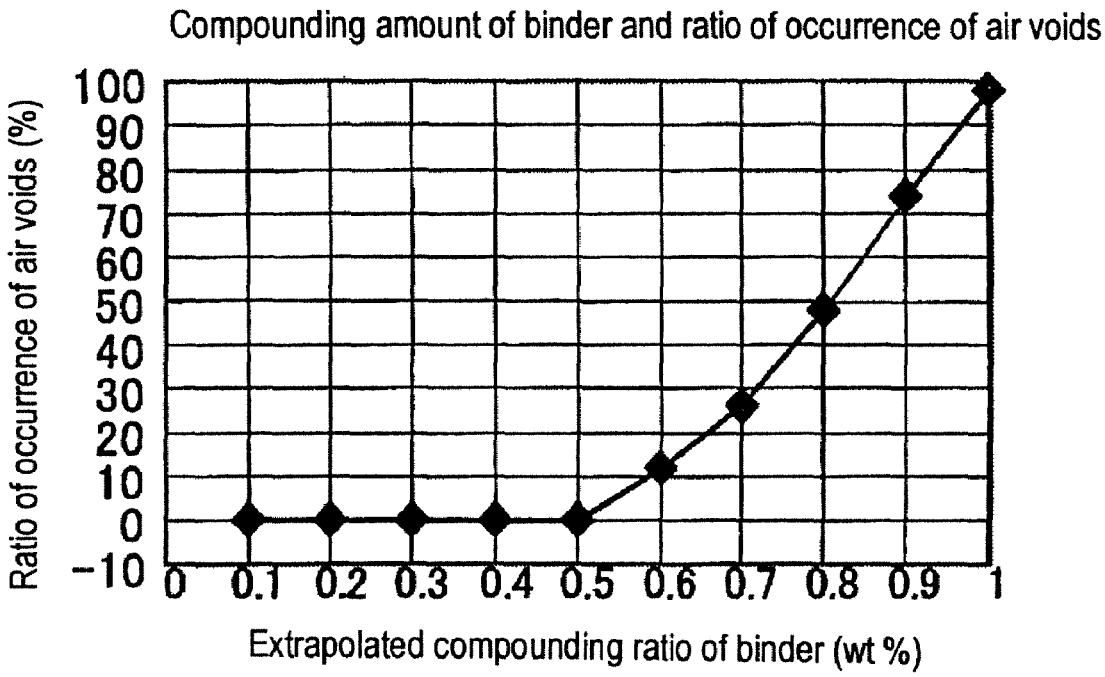
FIG. 3 is a graph showing the compounding ratio of nitrocellulose as a binder based on the total amount of zirconium and potassium perchlorate in the ignition charge of this invention and the ratio of occurrence of air voids.

FIG. 3 is a graph showing the compounding ratio of nitrocellulose as a binder relative to the total amount of zirconium and potassium perchlorate and the ratio of occurrence of air voids. If the extrapolated compounding ratio of nitrocellulose as a binder exceeds 0.5% by weight, the excess will be at a disadvantage in inducing formation of air voids and resulting in lowering the reliability of ignition. Conversely, if this extrapolated compounding ratio of nitrocellulose as the binder falls short of 0.1% by weight, the shortage will be at a disadvantage in disabling acquisition of fluidity proper for slurry.

Figure 4:
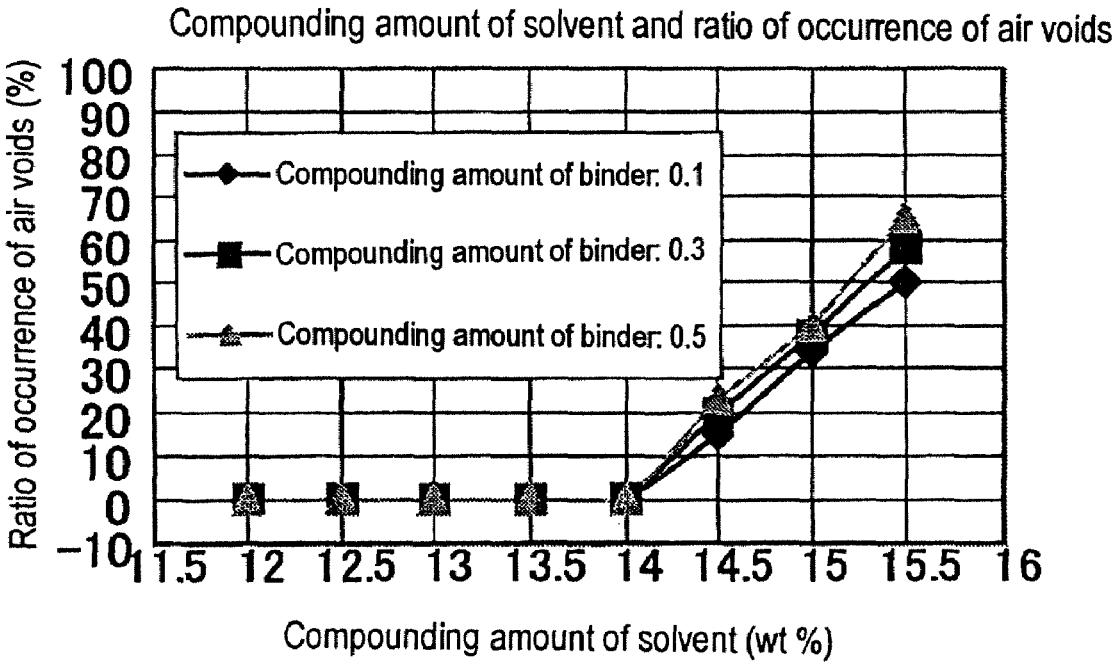
FIG. 4 is a graph showing the compounding ratio of isoamyl acetate as a solvent based on the total amount of zirconium and potassium perchlorate in the ignition charge of this invention and the ratio of occurrence of air voids.

FIG. 4 is a graph showing the compounding ratio of isoamyl acetate as a solvent relative to the total amount of zirconium and potassium perchlorate and the ratio of occurrence of air voids. If the compounding ratio of isoamyl acetate as a solvent exceeds 14.0% by weight, the excess will be at a disadvantage in inducing formation of air voids and resulting in lowering the reliability of ignition. Conversely, if this compounding ratio falls short of 12.5% by weight, the shortage will be at a disadvantage in disabling acquisition of fluidity proper for slurry.

Figure 5:
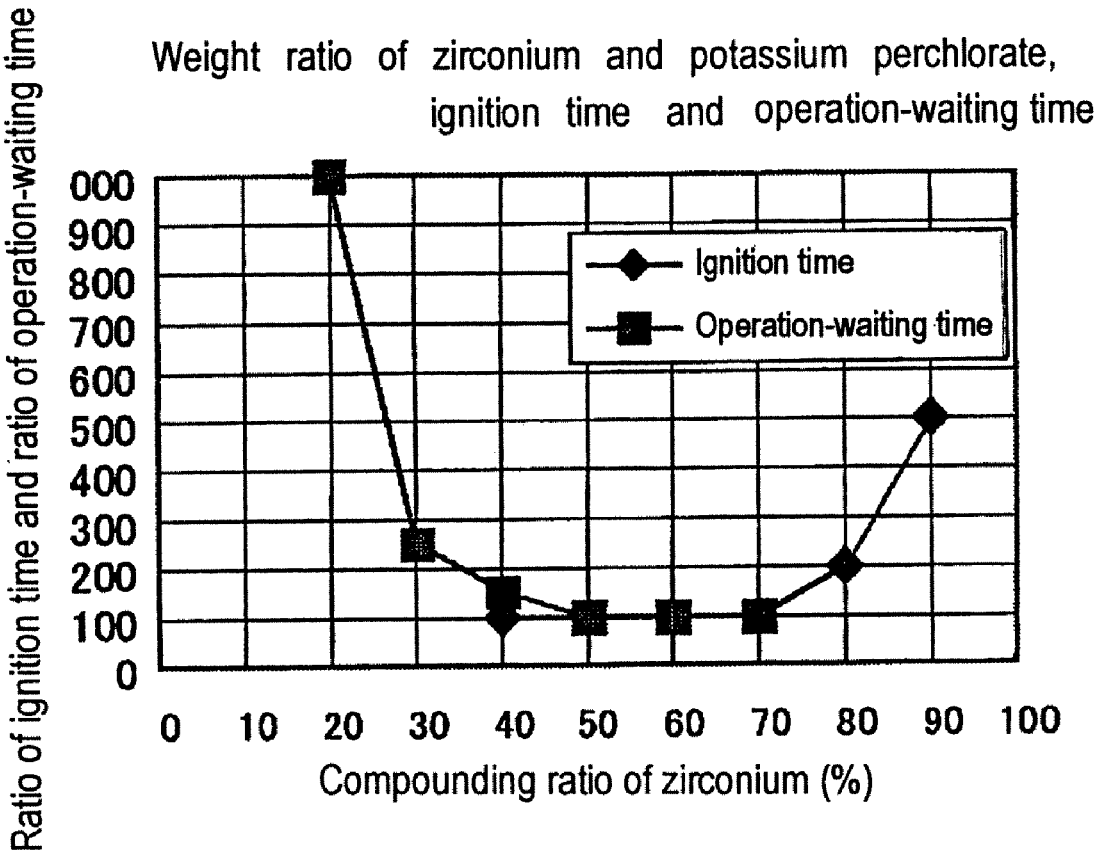
FIG. 5 is a graph showing the weight ratio of zirconium and potassium perchlorate in the ignition charge contemplated by this invention, the ignition time and the operation-waiting time of the gas generator serving as the yardstick for fire transferring property.

FIG. 5 is a graph showing the weight ratio of zirconium and potassium perchlorate, the ignition time and the operation-waiting time of the gas generator serving as the yardstick for fire transferring property. The weight ratio, 60%, of zirconium and the compounding ratio, 40%, of potassium perchlorate are respectively plotted as 100 in the graph. According to this graph, if the compounding ratio of zirconium falls short of 50% and that of potassium perchlorate exceeds 50%, the deviation will be at a disadvantage in unduly elongating the operation-waiting time. Conversely, if the compounding ratio of zirconium exceeds 70% and that of potassium perchlorate falls short of 30%, the deviation will be at a disadvantage in lowering the igniting property of the ignition charge.

Figure 6:
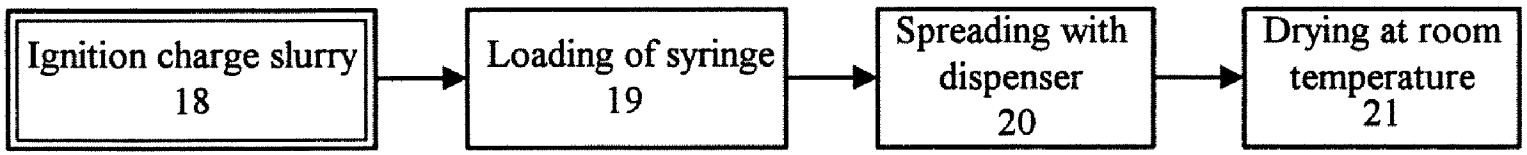
FIG. 6 is a block diagram showing a process contemplated by this invention for forming an ignition charge by spreading ignition charge slurry on the heat generating part of an initiator and drying the spread slurry.

FIG. 6 is a block diagram showing a process for forming an ignition charge by spreading an ignition charge slurry on a heat generating part of an initiator and drying the spread slurry. Ignition charge slurry 18 is thrown into a syringe during the step of syringe loading 19 and the syringe is set in a dispenser unit. Pressure of a prescribed magnitude is supplied from a dispenser to the set syringe for a prescribed length of time and the ignition charge slurry 18 is applied to the heat generating part of the initiator by the operation of dispenser spreading 20. The ignition charge is deposited on the heat generating part by subjecting the spread slurry to the operation of room temperature drying 21. Since this process enables the ignition charge slurry to be applied under fixed conditions, it is capable of providing an initiator revealing no marked dispersion and exhibiting enhanced quality. Since the handling proceeds on the slurry, the production is infallibly implemented with safety.

What is claimed is:

1. An initiator provided with an igniting mechanism for setting aflame an ignition charge by heat generated by an exothermic element connected via a pair of current conducting pins in response to an electric signal, said ignition charge being a slurry ignition charge which is formed mainly of a mixture consisting of zirconium as a fuel component and potassium perchlorate as an oxidizing agent component, having a weight ratio of 50 to 70% of zirconium to 30 to 50% of potassium perchlorate and which contains nitrocellulose as a binder component in a ratio of 0.1% by weight or more and 0.5% by weight or less based on a total amount of zirconium and potassium perchlorate and isoamyl acetate as a solvent in an extrapolated compounding ratio of 12.5% by weight or more and 14.0% by weight or less based on the total amount of zirconium and potassium perchlorate, said ignition charge being spread on the exothermic element and dried.

2. A method for the production of an initiator according to claim 1, comprising the step of handling the zirconium in a state converted into slurry with isoamyl acetate.

3. A method for the production of the initiator according to claim 1, comprising the steps of throwing the ignition charge into a syringe spreading the ignition charge thrown in the syringe on a heat generating part of the exothermic element with a dispenser and drying the spread ignition charge at room temperature or an elevated temperature.

* * * * *